US006956190B2

(12) United States Patent
Sano et al.

(10) Patent No.: US 6,956,190 B2
(45) Date of Patent: Oct. 18, 2005

(54) HIGH-FREQUENCY HEATING APPARATUS WITH STEAM GENERATING FUNCTION AND WATER SUPPLY CONTROLLING METHOD THEREFOR

(75) Inventors: Masaaki Sano, Kyoto (JP); Nobuhiro Ogawa, Nara (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 317 days.

(21) Appl. No.: 10/433,320

(22) PCT Filed: Jan. 15, 2003

(86) PCT No.: PCT/JP03/00281

§ 371 (c)(1),
(2), (4) Date: Jun. 2, 2003

(87) PCT Pub. No.: WO03/105536

PCT Pub. Date: Dec. 18, 2003

(65) Prior Publication Data

US 2005/0145622 A1 Jul. 7, 2005

(30) Foreign Application Priority Data

Jun. 5, 2002 (JP) ..... 2002-164837

(51) Int. Cl.[7] ..... H05B 6/68

(52) U.S. Cl. ..... 219/682; 219/716; 219/719; 219/756; 219/401; 99/325; 99/451

(58) Field of Search ..... 219/682, 681, 219/702, 719, 756, 716, 401; 99/325, 451

(56) References Cited

U.S. PATENT DOCUMENTS 6,040,564 A * 3/2000 Ueda et al. ..... 219/682
6,232,587 B1 * 5/2001 Kurita et al. ..... 219/682

FOREIGN PATENT DOCUMENTS

EP 0 517 681 A2 12/1992
EP 0 952 400 A1 10/1999
JP 54-136453 * 10/1979 ..... 219/682

OTHER PUBLICATIONS

Pantent Abstracts of Japan, "Roaster", Publication No. 59071929, Publication Date: Apr. 23, 1984, 1 page.

* cited by examiner

*Primary Examiner*—Philip H. Leung
(74) *Attorney, Agent, or Firm*—Pearne & Gordon LLP

(57) ABSTRACT

The object of the invention is to provide a water supply controlling method of a high-frequency heating apparatus and the high-frequency heating apparatus wherein water supplied to a heating chamber as steam is controlled in the quantity and the quality and power can be saved. To achieve the object, it is judged whether there is the required quantity of water supplied as steam in cooking in a water tank or not and in case it is judged that the water is short, request for replacing water in the water tank is annunciated. Elapsed time since water in the water tank was last replaced is monitored and in case the elapsed time exceeds predetermined time, request for replacing the water is annunciated.

11 Claims, 11 Drawing Sheets

HIGH-FREQUENCY HEATING APPARATUS WITH STEAM GENERATING FUNCTION AND WATER SUPPLY CONTROLLING METHOD THEREFOR

TECHNICAL FIELD

The present invention relates to a water supply controlling method of a high-frequency heating apparatus that heats an object to be heated by combining a high frequency and steam heating, and the high-frequency heating apparatus executing the water supply controlling method.

BACKGROUND ART

Various high-frequency heating apparatuses in which a steam generator is provided and which execute a heating process, supplying steam to a cooking chamber which is a high-frequency heating chamber. Of such high-frequency heating apparatuses provided with a steam generating function, there are some provided with a water tank for supplying water to a steam generator for suitably supplying steam required for a heating process to a high-frequency heating chamber. In that case, a water residual quantity sensor is provided to the water tank to detect that the water tank contains water and a transparent window is provided to the water tank to enable a user to check whether the water tank contains water or not.

However, it can be checked by the residual quantity sensor and the transparent window whether the water tank contains water or not, however, it cannot be verified when the water was supplied to the water tank and a sanitary problem may be caused. It can be checked whether the water tank contains water or not, however, there is a problem that it cannot be judged whether the quantity of the water is enough for next cooking or not. The water residual quantity sensor provided to the water tank requires adjustment and maintenance, the number of parts is also increased and the cost is increased.

To solve such problems, simply, water in a water tank is replaced every heating process and after the water tank is filled with new water, a heating process has only to be executed. However, there is a problem that in continuous heating, it is very troublesome and inefficient to detach a water tank and replace water in the water tank every heating process. There is a problem that the constant control of the quantity of water in a water tank requires that a power source of an electronic oven is normally kept turned on and there is a problem that the constant control prevents power saving.

DISCLOSURE OF INVENTION

The invention is made in view of the problems and the object is to provide a water supply controlling method of a high-frequency heating apparatus and the high-frequency heating apparatus in which water supplied to a heating chamber as steam is controlled in the quantity and the quality and power can be saved.

To achieve the object, in a high-frequency heating apparatus comprising a water tank attached to a body of the high-frequency heating apparatus so that the water tank can be detached, and a pump for supplying water to a steam generator from the water tank and in which the steam generator supplies at least steam to a heating chamber for housing a heated object and heats the heated object, and water in the water tank is monitored, a water supply controlling method according to the first aspect of the invention comprises a step of calculating elapsed time since water was supplied to the water tank and the water tank was attached to the body of the high-frequency heating apparatus and quantity of residual water in the water tank, and a step of annunciating request for replacing water in the water tank, when the elapsed time is equal to or exceeds preset predetermined time or the quantity of residual water in the water tank is equal to or less than the preset minimum quantity of held water.

According to the water supply controlling method of the high-frequency heating apparatus, as the elapsed time since water was supplied to the water tank and the water tank was attached to the body of the high-frequency heating apparatus and the quantity of residual water in the water tank are calculated, it is judged that water in the water tank is old water having a sanitary problem when the elapsed time is equal to or exceeds the preset predetermined time, it is judged that water of quantity required for a heating process is not left and request for replacing water in the water tank is noticed when the quantity of residual water in the water tank is equal to or less than the preset minimum quantity of held water, old water having a sanitary problem is prevented beforehand from being used in heating and normal heating can be prevented before hand from being not executed due to the shortage of water in the heating process. Therefore, water supplied to the heating chamber can be controlled in the quantity and the quality.

According to second aspect of the invention, the water supply controlling method of a high-frequency heating apparatus is characterized in that the quantity of residual water in the water tank is equivalent to quantity acquired by subtracting the quantity of water already supplied to the steam generator from the capacity of the whole water tank and the already supplied quantity is equivalent to the product of the cumulative frequency of drives of the pump for intermittently discharging water of fixed quantity and the quantity of discharged water per one drive of the pump.

According to the water supply controlling method of the high-frequency heating apparatus, the quantity of residual water in the water tank can be easily calculated by subtracting the product of the cumulative frequency of drives of the pump and the quantity of discharged water per one drive of the pump from the capacity of the whole water tank.

According to the third aspect of the invention, a water supply controlling method of a high-frequency heating apparatus is characterized in that the preset minimum quantity of held water is the minimum quantity of water supplied to the steam generator for acquiring a steam amount required for one heating process for a heated object.

According to the water supply controlling method of the high-frequency heating apparatus, as the quantity of water used for future heating is adopted for the minimum quantity of held water, a situation that water is short during a heating process can be avoided beforehand.

According to the fourth aspect of the invention, a water supply controlling method of a high-frequency heating apparatus is characterized in that the annunciation is made before an object to be heated is heated.

According to the water supply controlling method of the high-frequency heating apparatus, as request for replacing water is annunciated prior to a heating process, water can be efficiently supplied without useless heating operation.

According to the fifth aspect of the invention, a high-frequency heating apparatus comprises: a high frequency generator that supplies a high frequency to a heating chamber for housing a heated object; a steam generator that supplies steam to the heating chamber; a pump that supplies water to the steam generator; a water tank as a source of water supplied to the pump, which is detachably attached to the body of the high-frequency heating apparatus; a water tank detector that detects whether the water tank is attached to or detached from the body of the high-frequency heating apparatus; a timer that counts elapsed time since the water tank detector detected the installation of the water tank; a memory that stores the information of the quantity of water already supplied to the steam generator by the pump; annunciating means that annunciates request for replacing water in the water tank; and a controller that makes annunciation by the annunciating means executed when it is judged that elapsed time counted by the timer is equal to or exceeds preset predetermined time or the quantity of residual water in the water tank based upon the information of the already supplied quantity stored in the memory is equal to or less than the preset minimum quantity of held water.

According to the high-frequency heating apparatus, as elapsed time since water was supplied to the water tank and the water tank was attached to the body of the high-frequency heating apparatus is referred from the timer, the quantity of residual water in the water tank is referred from the memory, the controller judges that water in the water tank is old water having a sanitary problem when the elapsed time is equal to or exceeds the preset predetermined time, judges that water of quantity required for heating is not left when the quantity of residual water in the water tank is equal to or less than the preset minimum quantity of held water and makes request for replacing water in the water tank annunciated, the old water having a sanitary problem is prevented beforehand from being used in a heating process and a normal heating process can be prevented beforehand from being not executed due to the shortage of water during heating. Therefore, water supplied to the heating chamber can be controlled in the quantity and the quality.

According to sixth aspect of the invention, a high-frequency heating apparatus is characterized in that the pump intermittently discharges water of fixed quantity and the information of the already supplied quantity is equivalent to the frequency of drives of the pump.

According to the high-frequency heating apparatus, as the pump intermittently discharges water of fixed quantity, the quantity of already supplied water can be easily calculated by counting the frequency of drives of the pump.

According to seventh aspect of the invention, a high-frequency heating apparatus is characterized in that when the water tank detector detects the installation of the water tank, the count of the timer and the information of already supplied quantity stored in the memory are reset.

According to the high-frequency heating apparatus, as the timer and the memory are reset when the water tank detector detects that the water tank is newly installed, elapsed time and already supplied quantity are measured from this time.

According to eighth aspect of the invention, a high-frequency heating apparatus is characterized in that the annunciating means annunciates by display on a display panel provided to the body of the high-frequency heating apparatus.

According to the high-frequency heating apparatus, as annunciation is made using the display panel provided to the high-frequency heating apparatus, a user who operates for input on an operator panel can easily verify the contents of the annunciation and can securely recognize the contents of the annunciation. The annunciating means is not required to be separately provided and the increase of the cost for annunciation can be avoided.

According to ninth aspect of the invention, a high-frequency heating apparatus is characterized in that an auxiliary control circuit in which at least the timer is mounted and a main control circuit that controls heating in the high-frequency heating apparatus are formed as separate circuits each power source of which is independent and the auxiliary control circuit is always energized independent of whether the main control circuit is energized or not.

According to the high-frequency heating apparatus, the timer required to be always energized is mounted in the auxiliary control circuit which is a low-power circuit and is disconnected from the main control circuit which executes a heating process. Therefore, even if a power source of the main control circuit is turned off, elapsed time since the water tank was installed can be monitored.

According to tenth aspect of the invention, a high-frequency heating apparatus is characterized in that the memory is mounted in the auxiliary control circuit.

According to the high-frequency heating apparatus, as the memory is mounted in the auxiliary control circuit, the information of already supplied quantity from the water tank can be monitored even if the power source of the main control circuit is turned off.

According to eleventh aspect of the invention, a high-frequency heating apparatus is characterized in that the auxiliary control circuit is a low-power circuit the power consumption of which is 50 mW or less.

According to the high-frequency heating apparatus, standby power in the whole high-frequency heating apparatus in case the power source of the main control circuit is turned off can be regarded as zero and the high effect of power saving can be acquired.

BEST MODE FOR CARRYING OUT THE INVENTION

Figure 1:
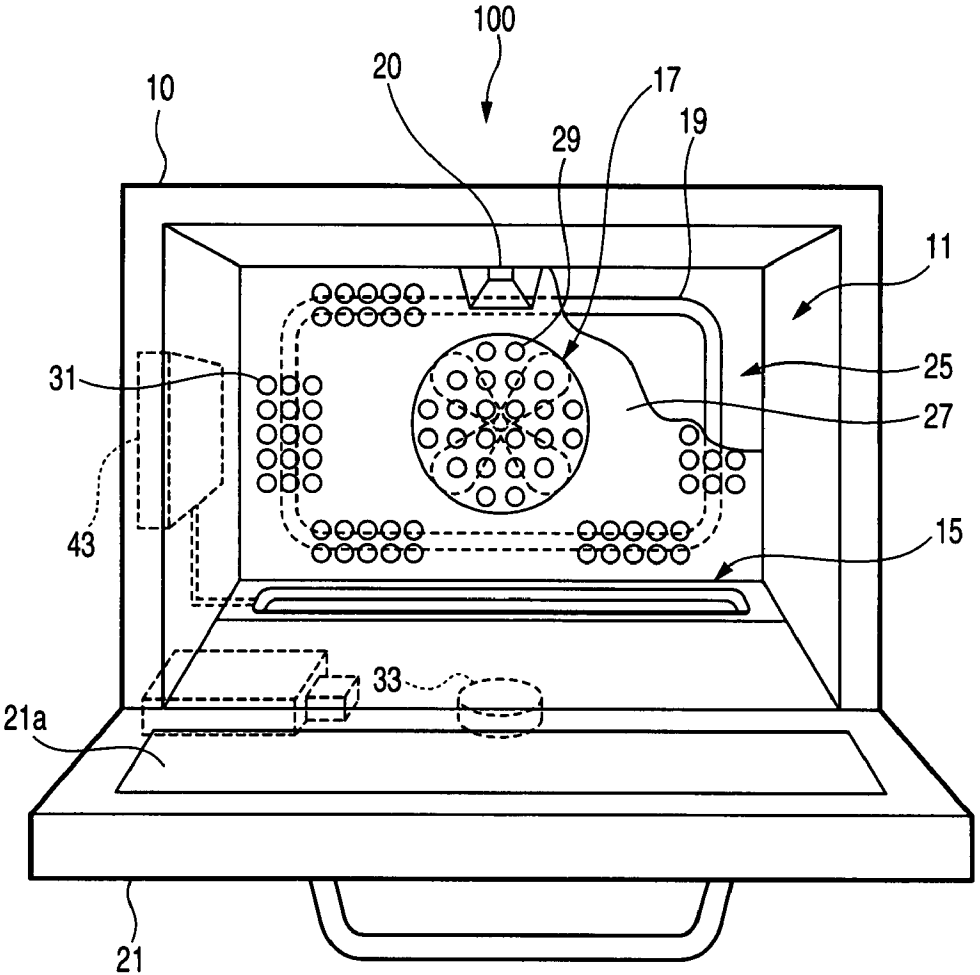
FIG. 1 is a front view showing a state in which an/a opening/closing door of a high-frequency heating apparatus according to the invention is open.

Referring to the drawings, suitable embodiments of a water supply controlling method of a high-frequency heating apparatus and the high-frequency heating apparatus according to the invention will be described in detail below.

Figure 2:
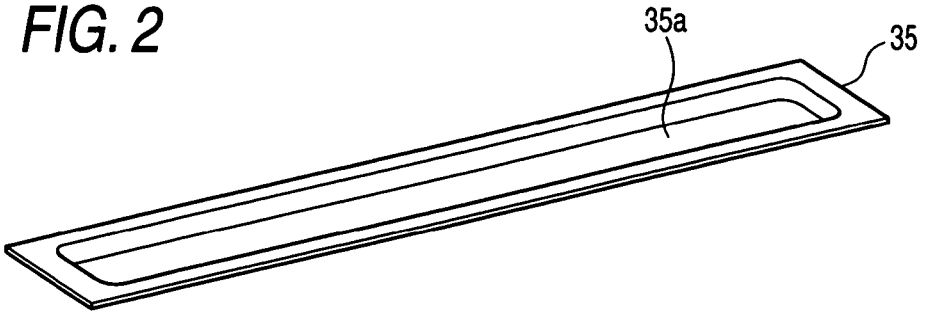
FIG. 2 is a perspective view showing an evaporation pan of a steam generator used for the high-frequency heating apparatus shown in FIG. 1.
Figure 3:
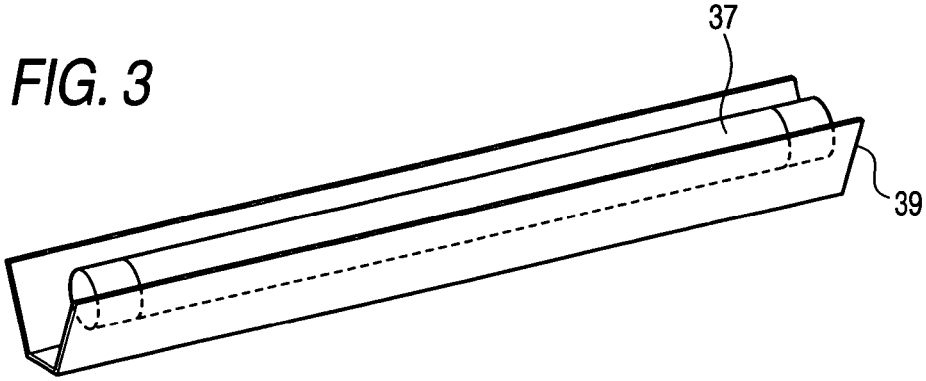
FIG. 3 is a perspective view showing an evaporation pan heater and a reflector of the steam generator.
Figure 4:
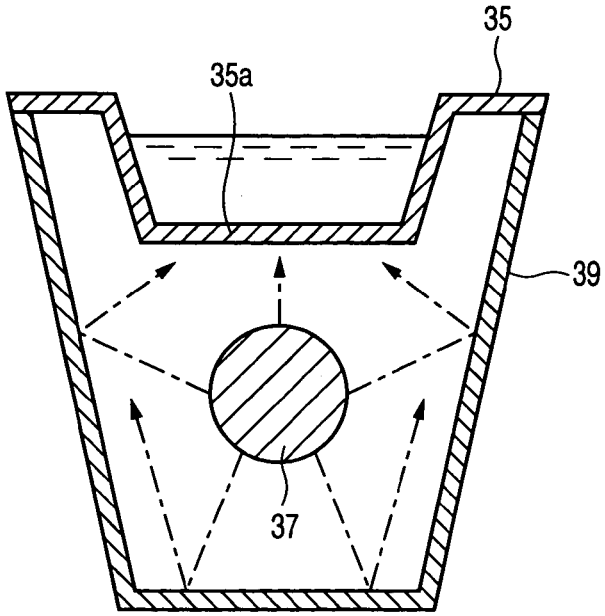
FIG. 4 is a sectional view showing the steam generator.

FIG. 1 is a front view showing a state in which an/a opening/closing door of the high-frequency heating apparatus according to the invention is open, FIG. 2 is a perspective view showing an evaporation pan of a steam generator used in this apparatus, FIG. 3 is a perspective view showing an evaporation pan heater and a reflector of the steam generator and FIG. 4 is a sectional view showing the steam generator.

First, the basic configuration and the basic operation of the high-frequency heating apparatus 100 according to the invention will be described.

The high-frequency heating apparatus 100 provided with a steam generating function is a cooking device that supplies at least either a high frequency (microwave) or steam to a heating chamber 11 for housing an object to be heated and heats the object to be heated. The high-frequency heating apparatus described above is provided with a magnetron 13 that generates a high frequency as a high frequency generator, a steam generator 15 that generates steam in the heating chamber 11, a circulating fan 17 that agitates and circulates air in the heating chamber 11, a convection heater 19 that heats air circulated in the heating chamber 11 as an indoor air heater, an infrared ray sensor 20 that detects temperature in the heating chamber 11 via holes for detection provided on the wall of the heating chamber 11 and a water tank 43 for supplying water to the steam generator 15.

Figure 10:
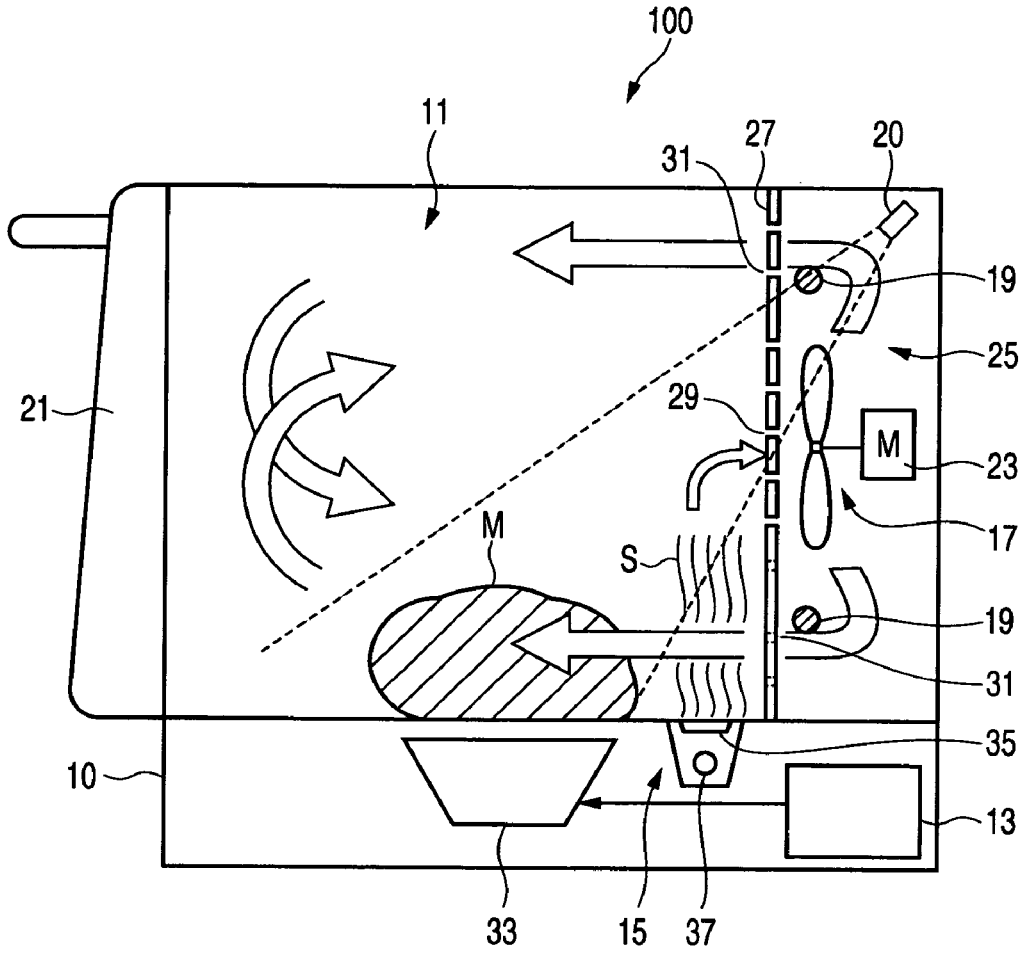
FIG. 10 is an explanatory drawing for explaining the operation of the high-frequency heating apparatus.

The heating chamber 11 is formed inside the box-type body 10 the front of which is open of the high-frequency heating apparatus and an/a opening/closing door 21 provided with a light transmission window 21*a* for opening or closing a heated object hatch of the heating chamber 11 is provided to the front of the body 10 of the high-frequency heating apparatus. The opening/closing door 21 can be opened or closed by connecting the lower end to a lower edge of the body 10 of the high-frequency heating apparatus via a hinge. Predetermined heat insulating space is secured between the heating chamber 11 and a wall of the body 10 of the high-frequency heating apparatus and heat insulating material is filled in the space if necessary. Space at the back of the heating chamber 11 functions as a circulating fan chamber 25 in which the circulating fan 17 and a motor 23 for driving it (see FIG. 10) are housed and the rear wall of the heating chamber 11 functions as a diaphragm 27 that partitions the heating chamber 11 and the circulating fan chamber 25. A ventilating hole for an intake 29 for intake from the side of the heating chamber 11 to the side of the circulating fan chamber 25 and a ventilating hole for a blast 31 for blast from the side of the circulating fan chamber 25 to the side of the heating chamber 11 are provided in different areas of the diaphragm 27. Each ventilating hole 29, 31 is formed as multiple punched holes.

The circulating fan 17 is arranged with the center of the rotation in the center of the rectangular diaphragm 27 and in the circulating fan chamber 25, the rectangular ring-shaped convection heater 19 is provided so that the convection heater surrounds the circulating fan 17. The ventilating holes for an intake 29 formed on the diaphragm 27 are arranged before the circulating fan 17 and the ventilating holes for a blast 31 are arranged along the rectangular ring-shaped convection heater 19. As the circulating fan 17 is set so that wind flows from the front side of the circulating fan 17 to the rear side on which the driving motor 23 is located when the circulating fan 17 is turned, air in the heating chamber 11 is drawn in the center of the circulating fan 17 via the ventilating hole for an intake 29, passes the convection heater 19 in the circulating fan chamber 25 and is sent into the heating chamber 11 via the ventilating hole for a blast 31. Therefore, air in the heating chamber 11 is circulated via the circulating fan chamber 25 by this flow, being agitated.

The magnetron 13 is arranged in space under the heating chamber 11 for example and a stirrer vane 33 is provided to a position for receiving a high frequency generated by the magnetron. A high frequency radiated on the stirrer vane 33 from the magnetron 13 is supplied by turning the stirrer vane 33, being agitated in the heating chamber 11. The magnetron 13 and the stirrer vane 33 are not only provided at the bottom of the heating chamber 11 but may be also provided on the upper surface and on the side of the heating chamber 11.

The steam generator 15 is composed of an evaporation pan 35 having a water reservoir concave portion 35*a* for generating steam by heating, an evaporation pan heater 37 arranged under the evaporation pan 35 for heating the evaporation pan 35 as shown in FIGS. 3 and 4 and a reflector 39 the cross section of which is substantially U type that reflects heat radiated from the heater toward the evaporation pan 35 as shown in FIG. 2. The evaporation pan 35 is made of a stainless elongated plate for example, is arranged at the bottom of the inside on the reverse side to the heated object hatch of the heating chamber 11 with the longitudinal direction along the diaphragm 27 and is provided outside a range of a temperature detection scan by the infrared ray sensor 20. For the evaporation pan heater 37, a glass tube heater, a sheathed heater and a plate heater can be utilized.

Figure 5:
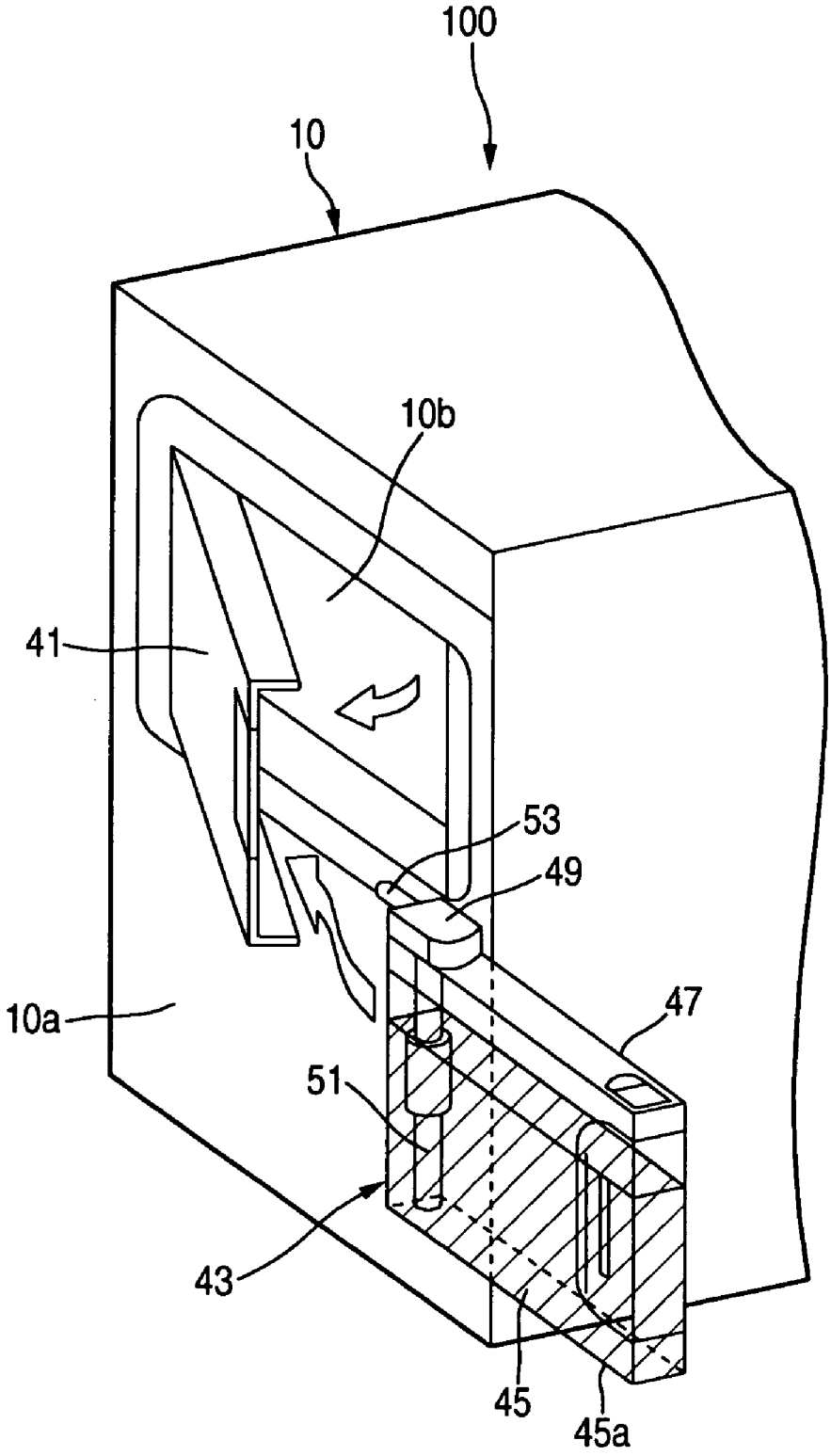
FIG. 5 is an explanatory drawing showing a state in which a water tank is housed on the side of the high-frequency heating apparatus.
Figure 6:
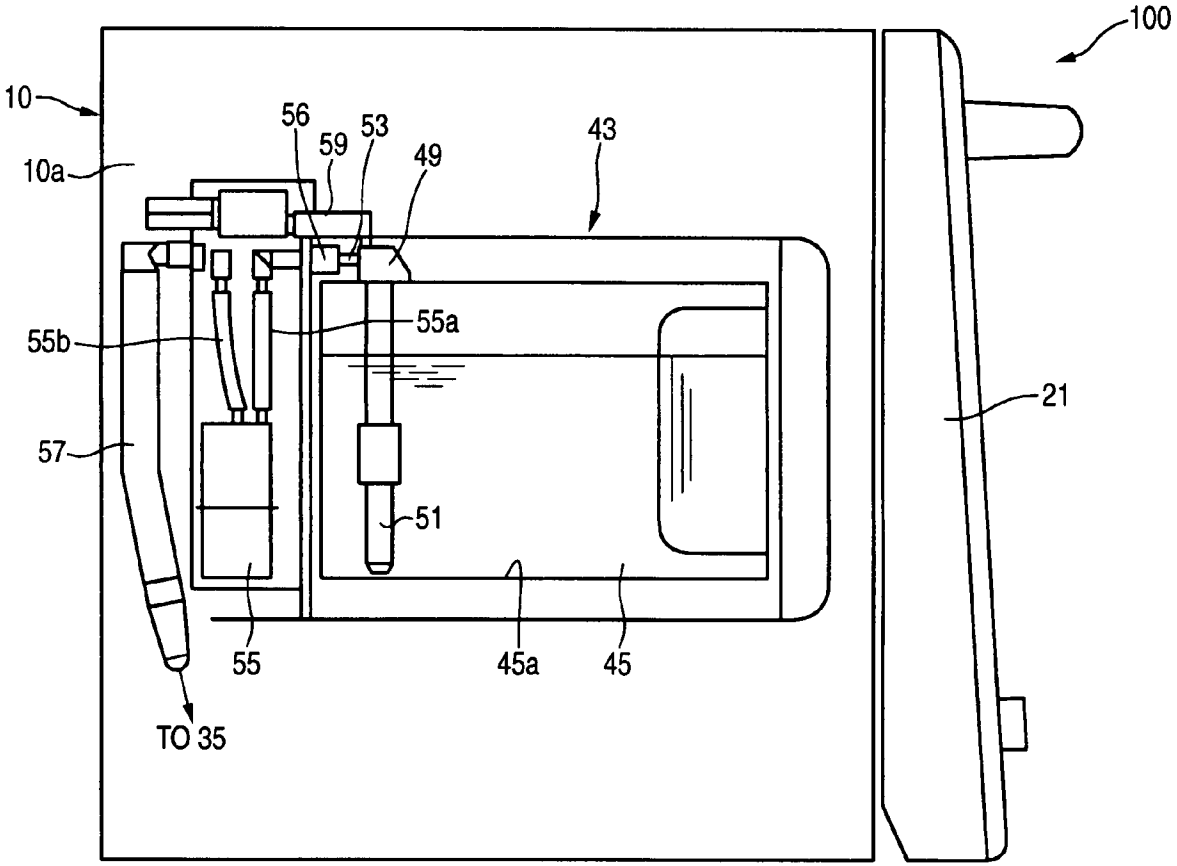
FIG. 6 is a side view showing the high-frequency heating apparatus.

FIG. 5 is an explanatory drawing showing a state in which a water tank is housed on the side of the high-frequency heating apparatus and FIG. 6 is a side view showing the high-frequency heating apparatus. As shown in FIG. 5, a lid for a water tank 41 is provided to the side wall 10*a* of the body 10 of the high-frequency heating apparatus so that the lid can be opened and a water tank 43 for supplying water to the steam generator 15 is housed in the internal space 10*b* of the side wall 10*a* so that the water tank can be detached. Also referring to FIG. 6, the water tank 43 is provided with the thin rectangular body 45 the upper part of which is open and a cap 47 attached to an opening of the body 45 so that the cap can be detached. An intake pipe fitting 49 is provided to the cap 47 and an intake pipe 51 piercing the cap 47 and extended up to the vicinity of the bottom 45*a* of the body 45 is provided under the intake pipe fitting 49. A connecting pipe 53 is protruded from the rear (ahead in a direction in which the water tank is inserted in FIG. 5) of the intake pipe fitting 49.

As shown in FIG. 6, a pump 55 that intermittently discharges water of fixed quantity is provided in the internal space 10*b* of the sidewall 10*a* of the body 10 of the high-frequency heating apparatus, and a pipe on the intake side 55*a* and a pipe on the supply side 55*b* are connected to the pump 55. The end on the reverse side to the side of the pump 55 of the pipe on the intake side 55*a* is connected to a joint 56 to which the end of the connecting pipe 53 of the water tank 43 is connected so that the connecting pipe can be detached when the water tank 43 is housed in the body 10 of the high-frequency heating apparatus. In the meantime, the pipe on the supply side 55*b* is connected to the evaporation pan 35 of the steam generator 15 via a pipe 57. A water tank detector 59 for detecting the water tank 43 is provided above the intake pipe fitting 49 of the water tank 43 in the internal space 10*b* of the side wall 10*a* and detects whether the water tank 43 is housed or not. A microswitch can be used for the water tank detector 59.

Figure 7:
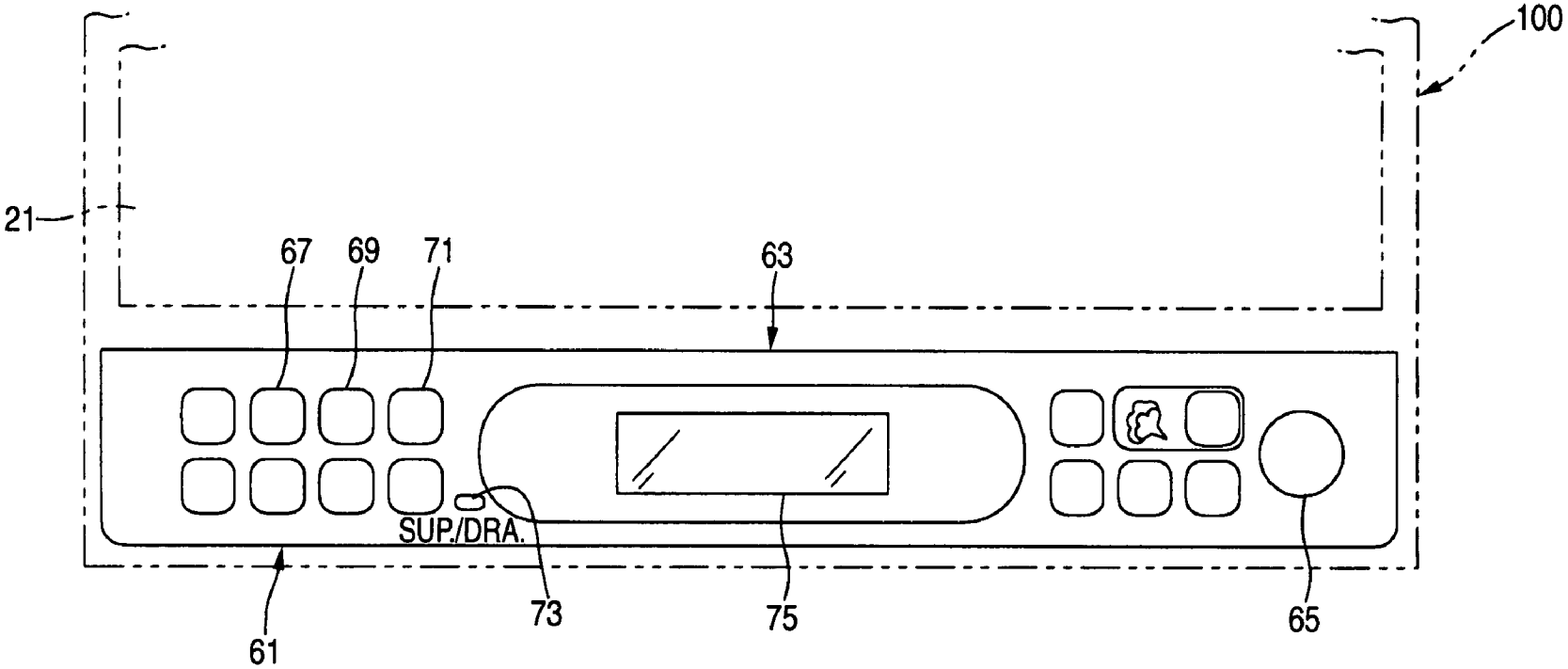
FIG. 7 is a front view showing a part of the opening/closing door of the high-frequency heating apparatus.

An input operator panel 61 and a display 63 are provided in a lower part of the opening/closing door 21 on the front side of the high-frequency heating apparatus 100 as a part of the opening/closing door of the high-frequency heating apparatus 100 is shown in FIG. 7. On the input operator panel 61, a start switch 65 for instructing the start of cooking, a manual steam switch 67 for turning on/off steam manually, an automatic steam switch 69 for turning on/off steam automatically and an automatic menu switch 71 for initiating a prepared program are provided. Also, on the display 63, a water supply/drainage lamp 73 as annunciating means and a display panel 75 are provided. Though the following function is not shown, a function for giving voice and an alarm may be also provided.

Figure 8:
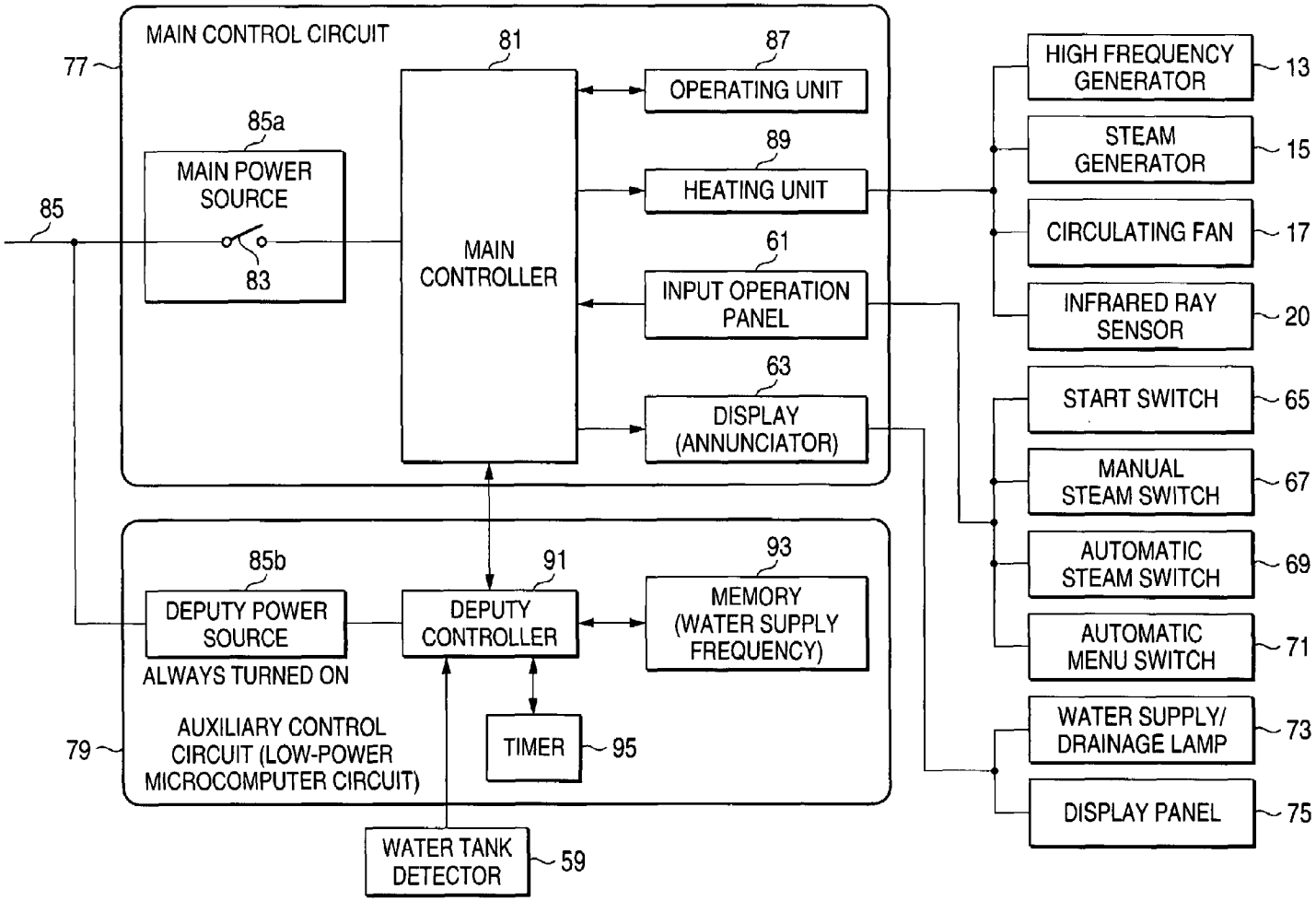
FIG. 8 is a control block diagram showing the high-frequency heating apparatus.

FIG. 8 is a control block diagram of the high-frequency heating apparatus. A control system is mainly composed of a main control circuit 77 and an auxiliary control circuit 79.

The main control circuit 77 is mainly composed of a main controller 81 provided with a microprocessor for example and the main controller 81 turns on/off a main power source 85*a* connected to a power supply line 85 via a main switch 83. The main control circuit 77 controls an operating unit 87, a heating unit 89, the input operator panel 61 and the display 63.

The high frequency generator 13, the steam generator 15, the circulating fan 17 and the infrared ray sensor 20 are connected to the heating unit 89, the high frequency generator 13 is operated in cooperation with the radio wave agitator (a drive unit of the stirrer vane) 33, and the evaporation pan heater 37, the indoor air heater 19 (the convection heater) and the pump 55 are connected to the steam generator 15.

The start switch 65, the manual steam switch 67, the automatic steam switch 69 and the automatic menu switch 71 for starting programmed automatic cooking are connected to the input operator panel 61, and the water supply/drainage lamp 73 and the display panel 75 are connected to the display (the annunciating means) 63.

The auxiliary control circuit 79 is a low-power microcomputer circuit the power consumption of which is 50 mW or less and even if the main power source 85*a* of the main control circuit 77 is turned off, the auxiliary control circuit is always energized. In view of the power consumption of the auxiliary control circuit 79, the standby power can be regarded as substantially zero. The auxiliary control circuit 79 is mainly composed of a deputy controller 91 provided with a microprocessor for example and connected to the main controller 81. Power is always supplied to the deputy controller 91 via a deputy power source 85*b* from the power supply line 85 and the deputy controller controls a memory 93, a timer 95 and the water tank detector 59. As the deputy power source of the deputy controller 91 is always connected, the deputy controller always monitors a state of the water tank detector 59. When the water tank 43 is detached from the body 10 of the high-frequency heating apparatus, water in it is replaced and the water tank is attached again, the timer 95 and the memory 93 can be reset even if the main power source 85*a* is turned off. It is desirable that the memory 93 is a non-volatile memory so that the contents are also stored in service interruption for example, however, the memory may be also a volatile memory to form it at a low price.

Figure 9:
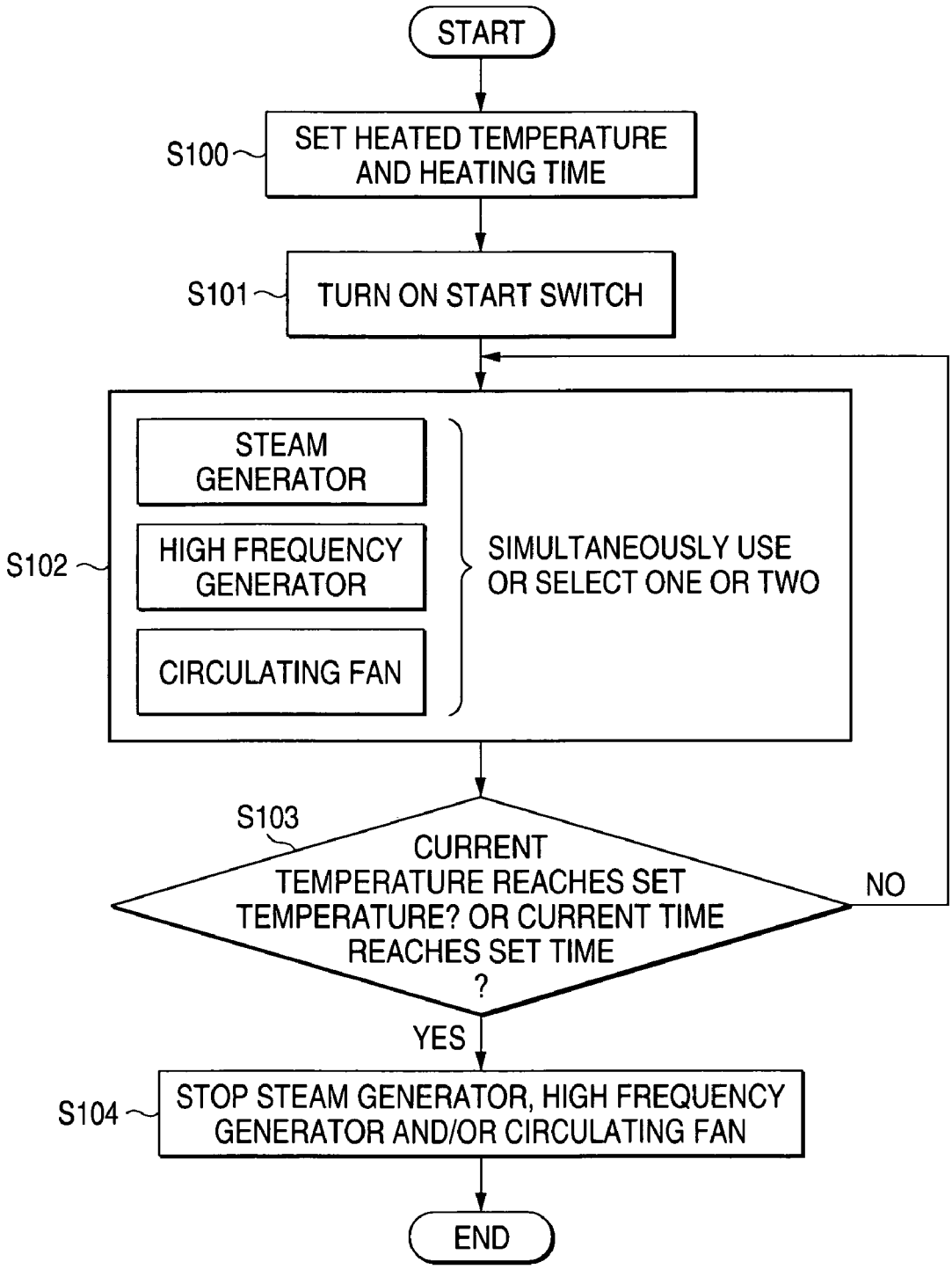
FIG. 9 is a flowchart explaining the basic operation of the high-frequency heating apparatus.

Next, referring to a flowchart shown in FIG. 9, the basic heating operation of the high-frequency heating apparatus 100 provided with the steam generating function will be described.

For a procedure for the operation, first, a heated object such as a food to be heated is laid on a dish, the dish is put in the heating chamber 11 and the opening/closing door 21 is closed. A heating method and heated temperature or heating time are set on the input operator panel 61 (a step 100, hereinafter abbreviated as S100) and the start switch 65 is turned on (S101). Then, heating is automatically made based upon a heating condition input by the control operation of the main controller 81 (S102).

That is, the main controller 81 reads set heated temperature and heating time, selects and executes an optimum cooking method based upon them, judges whether the current temperature and time reach the set heated temperature and heating time or not (S103), stops each heating source and terminates heating when the current values reach the set values (S104). In S102, the generation of steam, the operation of the indoor air heater, the turning of the circulating fan and high-frequency heating are individually or simultaneously made.

The action of the high-frequency heating apparatus 100 in case a steam heating mode is selected and executed in the operation described above will be described below. When the steam heating mode is selected, the evaporation pan heater 37 is turned on as shown in an explanatory drawing showing the operation of the high-frequency heating apparatus 100 in FIG. 10, as a result, water supplied from the water tank 43 by the pump 55 in the evaporation pan 35 is heated and steam S is generated. Steam S that rises from the evaporation pan 35 is sucked from the ventilating hole for an intake 29 provided substantially in the center of the diaphragm 27 to the center of the circulating fan 17 and is blown from the ventilating hole for a blast 31 provided to the periphery of the diaphragm 27 toward the heating chamber 11 via the circulating fan chamber 25.

The blown steam is agitated in the heating chamber 11 and is sucked again from the ventilating hole for an intake 29 substantially in the center of the diaphragm 27 to the side of the circulating fan chamber 25. Hereby, a circulating path is formed between the heating chamber 11 and the circulating fan chamber 25. No ventilating hole for a blast 31 is provided under a position in which the circulating fan 17 is arranged of the diaphragm 27 so that generated steam is led to the ventilating hole for an intake 29. Therefore, as shown by a void arrow in FIG. 10, steam is circulated in the heating chamber 11 and is efficiently blown on a heated object M.

At this time, as steam in the heating chamber 11 can be heated by the indoor air heater 19, the temperature of steam circulated in the heating chamber 11 can be also set to high temperature. Therefore, so-called superheated steam is acquired and cooking for grilling the surface of the heated object M is also enabled. In the case of high-frequency heating, a high frequency is supplied, being agitated in the heating chamber 11 by turning on the magnetron 13 and turning the stirrer vane 33 and high-frequency heating in which steam and a high frequency are combined is enabled.

Next, a water supply controlling method which is a characteristic of the invention will be described in detail.

Figure 11:
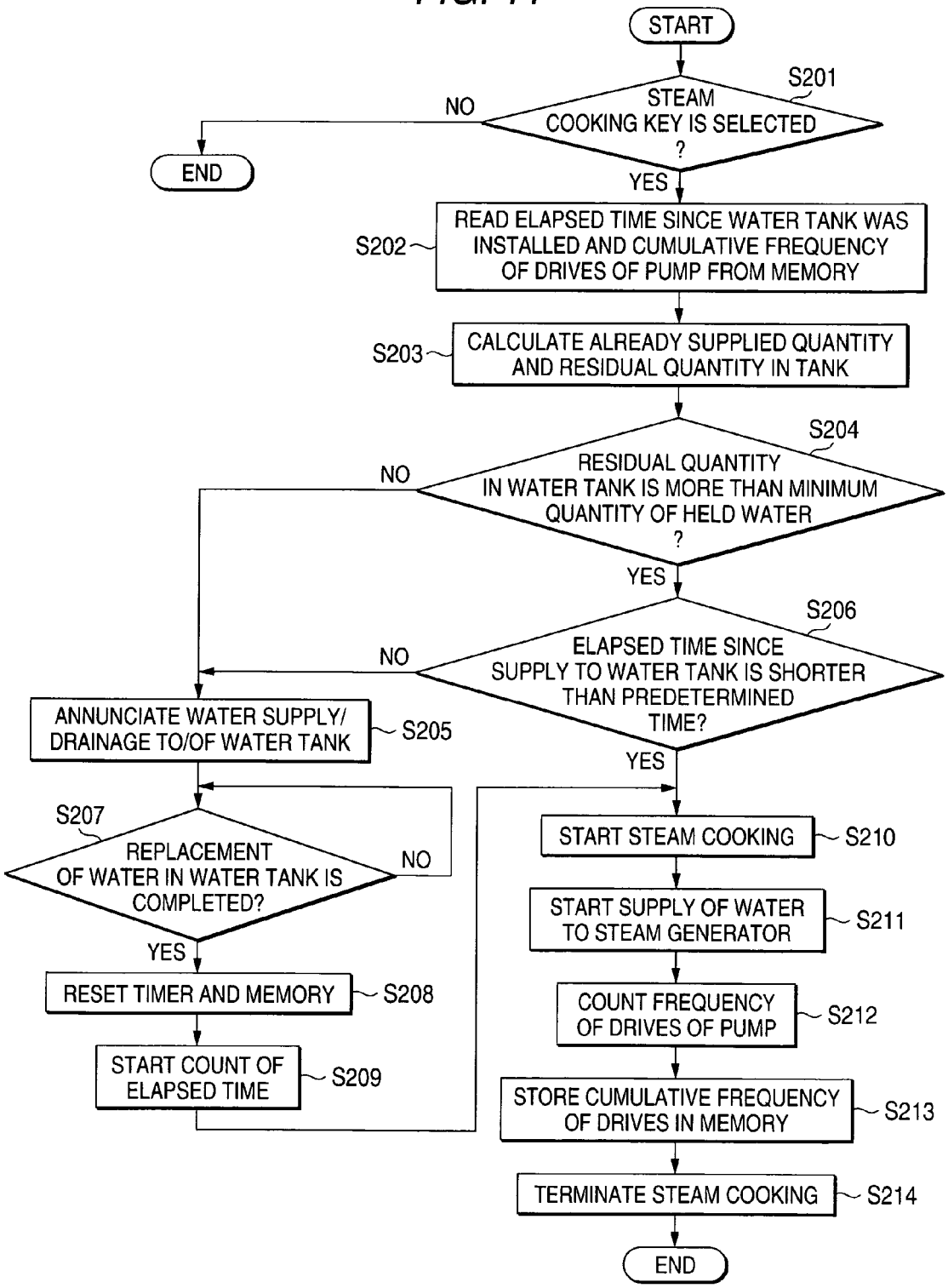
FIG. 11 is a flowchart showing a procedure for control in a first embodiment of a water supply controlling method of the high-frequency heating apparatus according to the invention.

FIG. 11 is a flowchart showing a procedure for a water supply controlling method equivalent to this embodiment. The water supply controlling method of the high-frequency heating apparatus 100 is characterized in that before the steam heating (hereinafter also called steam cooking) is started, a state of water in the water tank 43 is judged and it is annunciated if necessary that water should be drained from the water tank 43 or water should be supplied to the water tank.

As shown in FIG. 11, when cooking is started, it is judged whether the manual steam switch 67 or the automatic steam switch 69 is pressed or the automatic menu switch 71 is pressed and steam cooking is selected to first check whether the contents of heating are steam cooking or not (S201). As water in the water tank 43 is not used in case it is judged that steam cooking is not selected, this water supply control is terminated.

In case steam cooking is selected, elapsed time detected by the water tank detector 59 since the water tank was attached to the body 10 of the high-frequency heating apparatus is read from the timer 95 as the latest information of the currently installed water tank 43. Simultaneously, the cumulative frequency of the drives of the pump 55 since the water tank detector 59 detected the installation of the water tank 43 is read from the memory 93 (S202). The quantity of water already supplied from the water tank 43 as latest information is calculated by multiplying the quantity of discharged water per one drive of the pump 55 by the cumulative frequency of drives. That is, the already supplied quantity means the quantity of water already supplied to the steam generator 15 after the water tank 43 is attached to the body 10 of the high-frequency heating apparatus in a full state. Next, the calculated quantity of already supplied water is subtracted from the capacity (the full volume) of the whole water tank 43 and the quantity of residual water in the water tank 43 is calculated (S203). The main controller 81 compares the acquired current quantity of residual water in the water tank 43 with the preset minimum quantity of held water (S204). The minimum quantity of held water means the minimum quantity of water supplied to the steam generator to acquire the quantity of steam required for one heating of a heated object. In case the acquired current quantity of residual water is equal to or less than the minimum quantity of held water, water is short in steam cooking, heating is stopped and cooking fails.

In case it is judged by the main controller 81 that the quantity of residual water is short, the replacement of water in the water tank 43 is requested by the water supply/drainage lamp 73 and the display panel 75 as annunciating means (S205). In the meantime, in case the main controller 81 judges that the quantity of residual water is more than the minimum quantity of held water, it is judged whether elapsed time shown by the timer 95 since the water tank 43 was installed exceeds predetermined time or not (S206). In case it is judged that the elapsed time exceeds the predetermined time, it is judged that water in the water tank 43 is old water which has a sanitary problem and in S205, annunciation that requests the replacement of water in the water tank 43 is made.

The predetermined time means time to an extent that water housed in the water tank does not have a sanitary problem. Naturally, it is a principle to replace water in the water tank every cooking, however, assuming that replaced water can be used within 24 hours for example after the replacement of water particularly without difficulties, predetermined time is set to 24 hours in that case.

When request for replacing water in the water tank 43 is annunciated, a user extracts the water tank 43 form the body 10 of the high-frequency heating apparatus, drains the water tank 43 of water and fully supplies new water. When such replacement of water in the water tank 43 is completed, the water tank 43 is attached to the body 10 of the high-frequency heating apparatus again (S207). At this time, the water tank detector 59 detects the installation of the water tank 43 and the deputy controller 91 resets the timer 95 and the memory 93 (S208). The timer 95 initiates new count (counting time) since the installation was detected (S209). After the timer 95 initiates count, steam cooking is started (S210).

When steam cooking is started, the pump 55 is driven by a frequency required for supplying steam and water in the water tank 43 is intermittently supplied to the steam generator 15 (S211). A frequency in which the pump 55 is driven is counted according to the operation for supply (S212) and the cumulative frequency of drives is stored in the memory 93 (S213). As described above, steam cooking is completed, grasping the quantity of supplied water (S214).

According to the water supply controlling method of the high-frequency heating apparatus, as the quantity which can be supplied to the steam generator 15 of residual water in the water tank 43 is calculated in case steam cooking is selected for a type of heating and it is annunciated that water in the water tank 43 should be replaced in case the quantity of residual water is less than the predetermined minimum quantity of held water, steam cooking in which steam is supplied can be normally executed without being interrupted due to the shortage of water. Further, even if the quantity of residual water in the water tank 43 is equal to or more than the minimum quantity of held water, old water can be prevented from being used for cooking by monitoring elapsed time since water was last supplied to the water tank 43. Hereby, sanitary steam cooking is enabled.

As the quantity of residual water in the water tank 43 is acquired based upon the frequency of drives of the pump 55, a residual water sensor is not required to be provided to the water tank, hereby, adjustment and maintenance are not required and the cost of the whole apparatus can be reduced.

In the high-frequency heating apparatus 100, as the timer 95 and the memory 93 respectively required to be always energized are provided to the auxiliary control circuit 79 and power is supplied to them from the separate low-power deputy power source 85*b* independent from the main power source 85*a* of the main control circuit 77 for cooking, the auxiliary control circuit 79 can receive power even if the main power source 85*a* of the main control circuit 77 is turned off. Hereby, power for monitoring the water tank 43 can be minimized and power can be saved.

In this embodiment, when the quantity of residual water in the water tank 43 is judged, the quantity of residual water is calculated by subtracting a value acquired by multiplying the cumulative frequency of the drives of the pump 55 by discharged quantity per one drive from the full capacity of the water tank 43, and it is judged depending upon whether the quantity of the residual water is more than the minimum quantity of held water or not whether water in the water tank should be replaced or not, however, in place of this, the cumulative frequency of the drives of the pump 55 may be also only compared with a preset allowable frequency of drives. That is, a frequency of drives close to a frequency equivalent to the full capacity of the water tank 43 is preset as an allowable frequency of drives, in case the cumulative frequency of drives does not reach the allowable frequency of drives, it is judged that the quantity of residual water is enough and though the method is simple, the quantity of residual water can be judged. Also, in this case, in case water is short during cooking, an excessive numeric value for example may have only to be input to the memory 93 as a cumulative frequency of drives. For example, in case the frequency of drives of the drivable pump 55 since the water tank 43 was made full is 100 times, an excessive value such as 500 is input. Hereby, when steam cooking is selected next time and the initiation of cooking is tried, it is necessarily judged that the cumulative frequency of drives is larger than the allowable frequency of drives and the replacement of water is securely requested by the annunciating means.

Second Embodiment

Next, a second embodiment of the water supply controlling method of the high-frequency heating apparatus according to the invention will be described.

In this embodiment, at the time of steam cooking, it is judged whether there is the quantity of water equivalent to the quantity of supplied steam required for steam cooking in a water tank 43 or not and in case the water is short, request for replacing water in the water tank 43 is annunciated.

Figure 12:
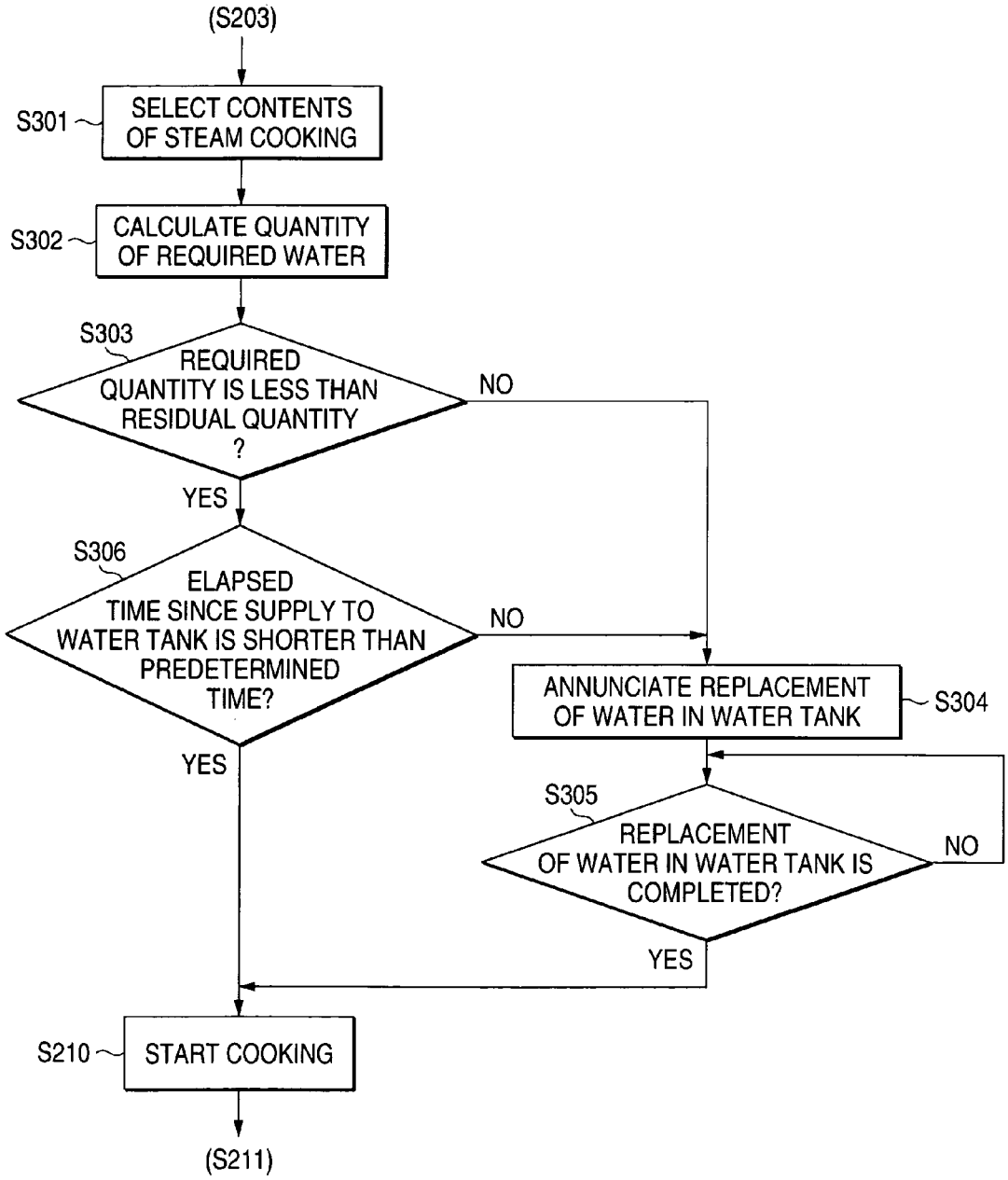
FIG. 12 is a flowchart showing a procedure for control in a second embodiment of the water supply controlling method of the high-frequency heating apparatus according to the invention.

For a procedure for control in this embodiment, only a part of the procedure for control in the first embodiment is different, the other part is similar and therefore, only the different part is shown in FIG. 12.

FIG. 12 is a flowchart showing the different part from the procedure for control in the first embodiment. The concrete procedure for control in this embodiment is as follows. That is, after S201 to S203 are finished, the automatic menu switch 71 is pressed and the contents of desired steam cooking are selected (S301). The quantity of water required according to the selected contents of steam cooking is estimated (S302). Referring to the result of calculating the current quantity of residual water in the water tank 43 in S203, the calculated quantity of required water and the quantity of residual water in the water tank 43 are compared (S303). The quantity of water required for cooking is not only calculated by a mathematical expression such as an empirical expression but a data base related to the contents of cooking and required quantity of water is prepared beforehand and the quantity of water required for cooking may be also acquired from the database.

As a result of comparison, in case the quantity of residual water is short, request for replacing water in the water tank 43 is annunciated by annunciating means (S304). When the replacement of water in the water tank 43 by a user is completed (S305), cooking is started (S211).

In the meantime, in case it is judged in S303 that the quantity of residual water is enough, it is judged whether elapsed time since water in the water tank 43 was last replaced exceeds predetermined time or not (S306) and in case the elapsed time exceeds the predetermined time, it is judged that water in the water tank 43 is old water having a sanitary problem and request for replacing the water is annunciated (S304). In case the elapsed time does not exceed the predetermined time in S306, cooking is started as it is (S211).

As described above, as the quantity of required water used for cooking is estimated in case steam cooking is selected and request for replacing water in the water tank 43, that is, an instruction for supplying water is annunciated in case the quantity of residual water housed in the water tank 43 is less than the quantity of the required water, a situation that water is short during cooking in the selected cooking can be avoided.

Figure 13:
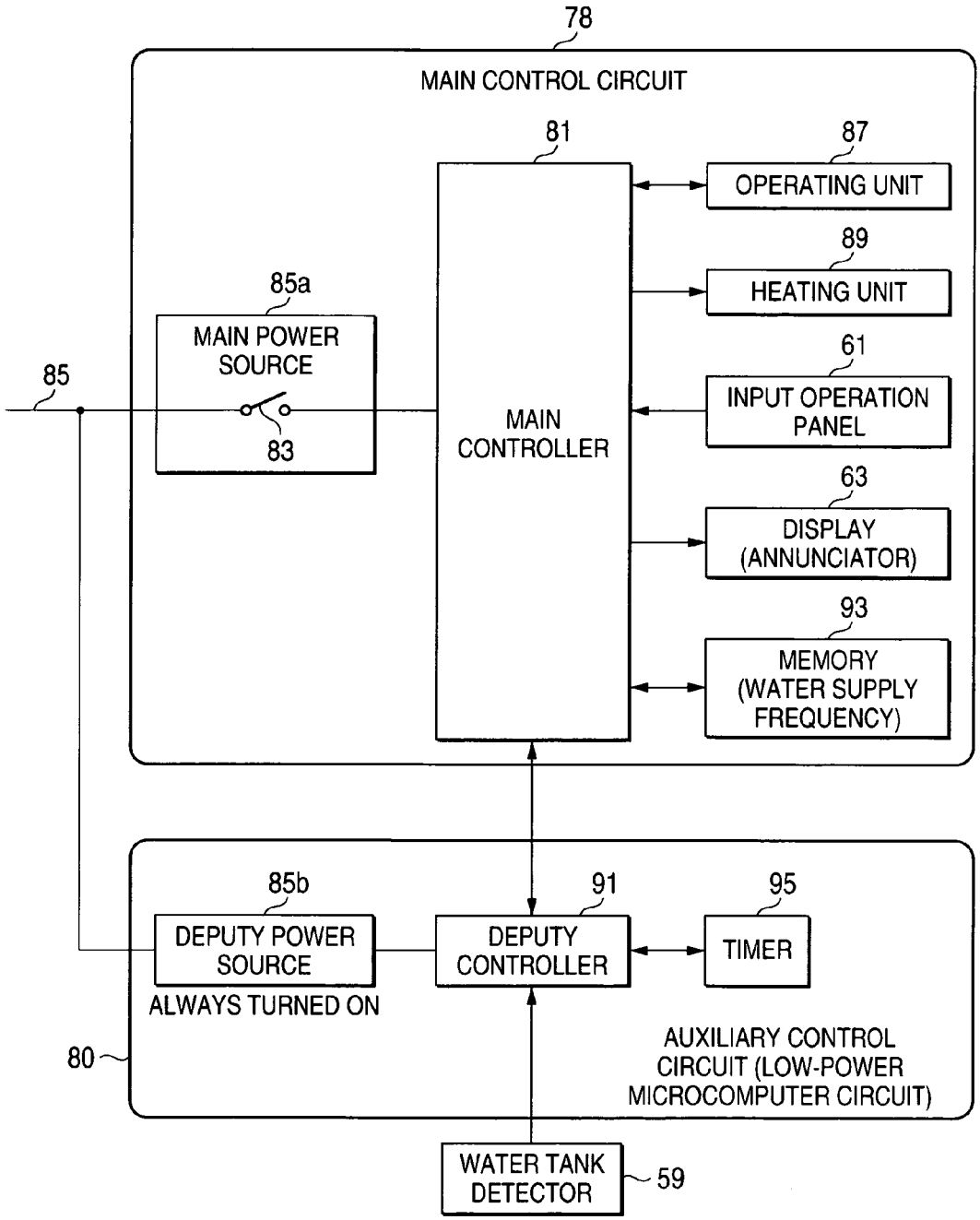
FIG. 13 is a control block diagram showing a varied part of the high-frequency heating apparatus.

The configuration of the control system of the high-frequency heating apparatus in each embodiment is not limited to the configuration mainly composed of the main control circuit 77 and the auxiliary control circuit 79 shown in FIG. 8 and may be also varied as follows. That is, as shown in a control block diagram showing another control system in FIG. 13, a memory 93 maybe also provided to the side of a main control circuit 78. As the supply of power from a main power source 85*a* to the memory 93 is disconnected, a non-volatile memory is used for the memory 93 in this case.

According to this configuration, the control of water in a water tank over elapsed time can be executed as described above. In case the main power source 85*a* of the main control circuit 78 is turned off when a deputy controller 91 detects the water tank, the deputy controller 91 notifies a main controller that the water tank is attached/detached when the main power source 85*a* is turned on next. The main controller 81 receives this notice and resets the memory 93.

As described above, the memory 93 may also be connected to either the main controller 81 or the deputy controller 91 and in both cases, the operation described in the first embodiment can be realized. An auxiliary control circuit 80 formed separately from the main control circuit 78 can be composed at a low price by limiting the function of the auxiliary control circuit 80 to the necessary and minimum function, the cost of the whole apparatus can be reduced and power can be saved.

The high-frequency heating apparatus according to the invention is not limited to each embodiment described above and may be suitably transformed and improved in a range which does not deviate from the object and the outline of the invention.

INDUSTRIAL APPLICABILITY

As described above, according to the water supply controlling method of the high-frequency heating apparatus and the high-frequency heating apparatus according to the invention, as the quantity of residual water supplied to the steam generator in the water tank is estimated when steam cooking is selected and request for replacing water in the water tank is annunciated in case the quantity of residual water is less than the predetermined minimum quantity of held water, also in case elapsed time since water was last supplied to the water tank exceeds the predetermined time and further, in case the quantity of required water used for heating is calculated and the quantity of residual water in the water tank is less than the required quantity, steam cooking in which steam is supplied can be executed without the shortage of water, old water is prevented from being used for cooking and sanitary steam cooking is enabled. Therefore, water supplied to the heating chamber as steam can be controlled both in quantity and quality.

In the high-frequency heating apparatus, as a state of water in the water tank is monitored by the auxiliary control circuit the power source of which is formed independent of the power source of the main control circuit and which is always energized, power can be saved.

What is claimed is:

1. In a high-frequency heating apparatus with steam generating function comprising a water tank attached to a body of the high-frequency heating apparatus so that the water tank can be detached, and a pump for supplying water to a steam generator from the water tank and in which the steam generator supplies at least steam to a heating chamber for housing a heated object and heats the heated object, and water in the water tank is monitored, a water supply controlling method comprising:

a step of calculating elapsed time since water was supplied to the water tank and the water tank was attached to the body of the high-frequency heating apparatus and quantity of residual water in the water tank; and a step of annunciating request for replacing water in the water tank, when the elapsed time is equal to or exceeds preset predetermined time or the quantity of residual water in the water tank is equal to or less than the preset minimum quantity of held water.

2. A water supply controlling method according to claim 1, wherein the quantity of residual water in the water tank is equivalent to quantity acquired by subtracting the quantity of water already supplied to the steam generator from the capacity of the whole water tank; and the already supplied quantity is equivalent to the product of the cumulative frequency of drives of the pump for intermittently discharging water of fixed quantity and the quantity of water discharged per one drive of the pump.

3. A water supply controlling method according to claim 1, where in the preset minimum quantity of held water is equivalent to the minimum quantity of water supplied to the steam generator to acquire a steam amount required for once heating a heated object.

4. A water supply controlling method according to claim 1, wherein the annunciation is made before the heated object is heated.

5. A high-frequency heating apparatus with steam generating function comprises:

a high frequency generator that supplies a high frequency to a heating chamber for housing a heated object;

a steam generator that supplies steam to the heating chamber; a pump that supplies water to the steam generator;

a water tank as a source of water supplied to the pump, which is detachably attached to the body of the high-frequency heating apparatus;

a water tank detector that detects whether the water tank is attached to or detached from the body of the high-frequency heating apparatus;

a timer that counts elapsed time since the water tank detector detected the installation of the water tank;

a memory that stores the information of the quantity of water already supplied to the steam generator by the pump; annunciating means that annunciates request for replacing water in the water tank; and a controller that makes annunciation by the annunciating means executed when it is judged that elapsed time counted by the timer is equal to or exceeds preset predetermined time or the quantity of residual water in the water tank based upon the information of the already supplied quantity stored in the memory is equal to or less than the preset minimum quantity of held water.

6. A high-frequency heating apparatus with steam generating function according to claim 5, wherein the pump intermittently discharges water of fixed quantity; and the information of the already supplied quantity is the frequency of drives of the pump.

7. A high-frequency heating apparatus with steam generating function according to claim 5 wherein when the water tank detector detects the installation of the water tank, the count of the timer and the information of already supplied quantity stored in the memory are reset.

8. A high-frequency heating apparatus with steam generating function according claim 5, wherein the annunciating means annunciates by display on a display panel provided to the body of the high-frequency heating apparatus.

9. A high-frequency heating apparatus with steam generating function according to claim 5, wherein an auxiliary control circuit in which at least the timer is mounted and a main control circuit that controls heating in the high-frequency heating apparatus are formed as separate circuits each power source of which is independent; and the auxiliary control circuit is always energized independent of whether the main control circuit is energized or not.

10. A high-frequency heating apparatus with steam generating function according to claim 9, wherein the memory is mounted in the auxiliary control circuit.

11. A high-frequency heating apparatus with steam generating function according to claim 9, wherein the auxiliary control circuit is a low-power circuit the power consumption of which is 50 mW or less.

* * * * *